United States Patent [19]

Lindberg et al.

[11] Patent Number: 4,730,476

[45] Date of Patent: Mar. 15, 1988

[54] PORTABLE CUTTER/CRIMPER

[75] Inventors: Verne L. Lindberg, Everett; Dan H. Martin, Lake Stevens, both of Wash.

[73] Assignee: Rasmussen Co., Inc., Seattle, Wash.

[21] Appl. No.: 840,018

[22] Filed: Mar. 17, 1986

[51] Int. Cl.[4] ..... B21D 7/00; B21D 41/04

[52] U.S. Cl. ..... 72/407; 29/566.1; 72/324; 72/416

[58] Field of Search ..... 29/566, 566.1, 566.3, 29/566.4; 140/105; 30/180, 228; 72/407, 409, 410, 453.1, 453.01, 416, 324, 453.16; 409/233

[56] References Cited

U.S. PATENT DOCUMENTS

| | | | |
|---|---|---|---|
| 492,931 | 3/1893 | Baird | 30/187 |
| 527,790 | 10/1894 | Heggen | 30/187 |
| 1,129,267 | 2/1915 | Baird | 30/187 |
| 3,706,245 | 12/1972 | Von Scholk | 30/180 |
| 3,888,003 | 6/1975 | Brown | 30/180 |
| 3,893,237 | 7/1975 | Jahnke | 30/180 |
| 4,109,504 | 8/1978 | Rommel | 72/453.16 |
| 4,558,584 | 12/1985 | Myers | 72/453.01 |
| 4,589,808 | 5/1986 | O'Conner | 409/233 |

*Primary Examiner*—Z. R. Bilinsky
*Attorney, Agent, or Firm*—Mark Zovko

[57] ABSTRACT

A portable cutter/crimper that can cut or crimp stranded cable for bundling logs. A pneumatic air bag is used to close the jaws of a pair of crimping arms which contain matching arcuate cut out portions for the cable connector to be crimped. Prior to operation, the crimping jaws are held open by a spring. The crimping arms also have cutting edges adjacent to the crimping jaws for cutting wire. A frame and handle are provided which have a trigger to initiate expansion of the air bag during operation. The force of the expanding air bag is transmitted to the crimping arms by two connecting arms rotably connected to the crimping arms. The assembly is partially housed in an aluminum housing, and is relatively light weight for easier field use.

4 Claims, 4 Drawing Figures

PORTABLE CUTTER/CRIMPER

BACKGROUND OF THE INVENTION

1. Field of the Invention

This invention relates in general to crimping stranded cable and more particularly to a cutter/crimping device for cutting or crimping stranded cable which is portable, efficient and relatively safe and used in bundling logs.

2. Discussion of the Prior Art

A number of patents showing prior art cutting devices for cable or the like have been discovered by a preliminary search. These patents are listed below:

| U.S. Pat. No. | Inventor | Issue Date |
|---|---|---|
| 3,893,237 | Jahnke | 7/8/75 |
| 3,888,003 | Brown | 6/10/75 |
| 527,790 | Heggen | 10/23/94 |
| 3,706,245 | Ban Schaik | 12/19/72 |
| 492,931 | Baird | 3/7/93 |

In general, these patent devices show various cutting tools, but do not anticipate the present invention. The operation and features of the present invention are new and distinct relative to the above patents.

SUMMARY OF THE INVENTION

The apparatus for crimping and cutting stranded cable or wire of the present invention includes a frame to which is connected one end of a rod. The rod has a baseplate on the other end. A pair of crimping arms is provided. The crimping arms having matching arcuate cut out portions or jaws for receiving the cable to be crimped. The crimping arms are rotably connected to the frame. A connecting arm is rotably pinned to each crimping arm and in turn rotably pinned to force transmission means. The force transmission means has a hole therethrough to receive the rod, and since the connecting arms are rotably pinned to it, lateral movement along the axis of the rod rotates the connecting arms and in turn the crimping arms about their point of attachment to the frame. This movement effects opening or closing of the jaws of the crimping arms.

In the crimping process a strand connector is used to receive the ends of the cable to be joined. The cable ends are fitted through the strand connector and the strand connector placed between the jaws of the crimping arms of the present invention prior to operation of the apparatus. The force transmission means is moved by an inflatable air bag. The air bag has a hole therethrough to receive the rod and be supported by the rod. The air bag is located between the base plate of the rod and the force transmission means. The air bag is connected to an outside source of pressurized air. Expansion of the air bag causes lateral movement of the force transmission means along the axis of the rod. Trigger means mounted on the frame is provided to activate the apparatus. The trigger means is connected to the air bag and a source of pressurized air. When the trigger means is depressed, the source of pressurized air rapidly inflates the air bag causing lateral movement of the force transmission means along the axis of the rod. This movement thereby causes closing of the crimping arm jaws. Releasing the trigger means causes depressurization and contraction of the air bag. To hold the jaws of the crimping arm open when the trigger is released, springs are provided which are connected to each end of the crimping arms opposite the jaws. The springs also cause the force transmission means to remain adjacent to the air bag when the air bag is contracted.

In the preferred embodiment of the invention cutting edges are provided adjacent to the jaws of the crimping arms for allowing the cutting of cable using the same operation as crimping. The apparatus also includes a housing for partially enclosing its working parts, and handle bars for easier operator manipulation.

It is therefore an object of the present invention to provide a stranded cable cutter/crimper which utilizes the action of an inflatable air bag to effect operation.

Another object of the present invention is to provide a cutter/crimper for stranded cable which is portable and relatively light in weight.

A further object of the present invention is to provide a crimper for stranded wire cable which also offers a wire cutter on the center line of the device.

A still further ojbect of the present invention is to provide a hand-held and operated cutter/crimper with superior operator safety features with respect to both operation and equipment failure.

These and other objects and advantages of the present invention will become more apparent from the following detailed description when taken in conjunction with the drawings.

DETAILED DESCRIPTION OF THE PREFERRED EMBODIMENT

Figure 4:
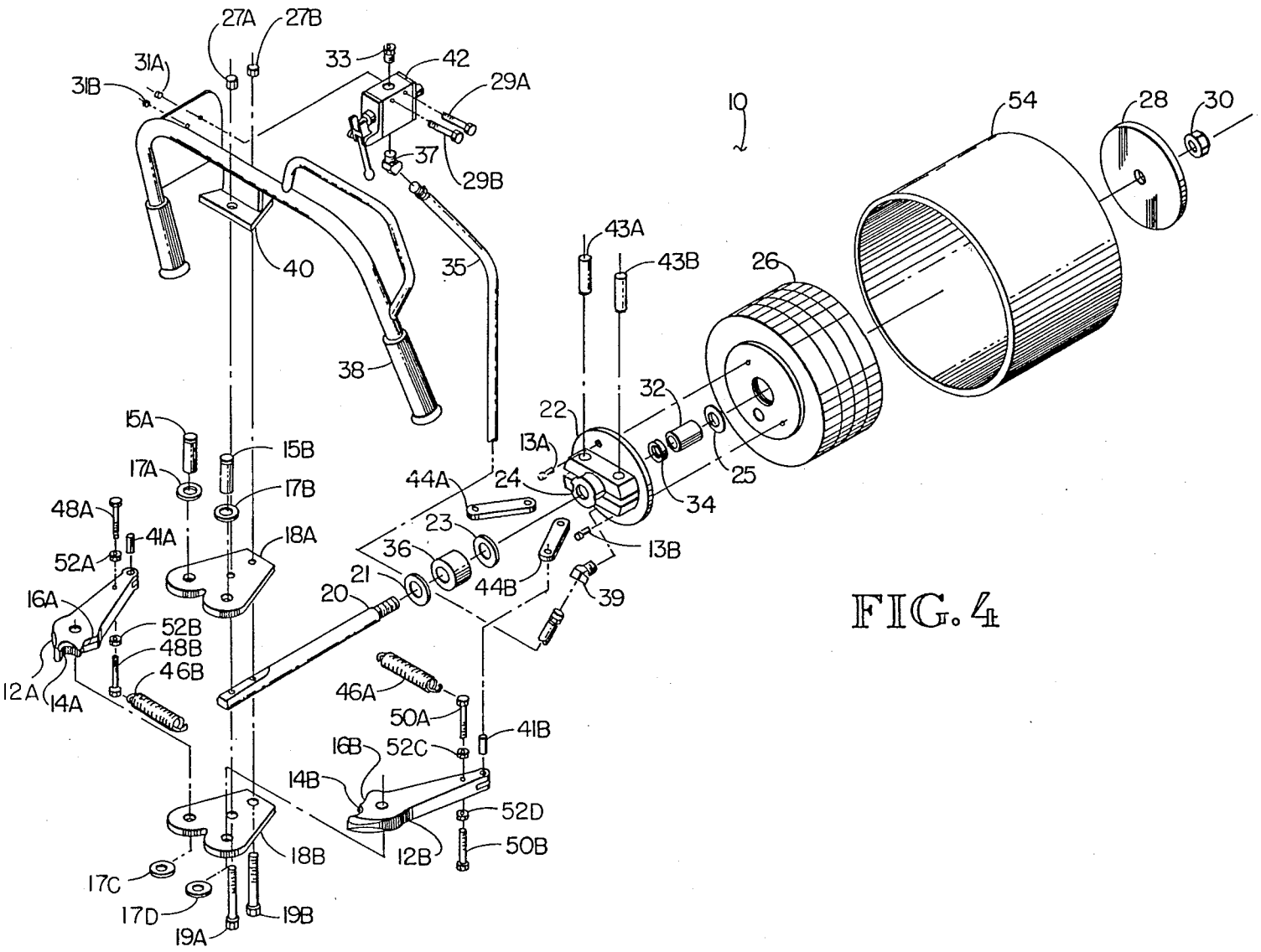
FIG. 4 is an exploded isometric view of the present invention.

Referring to the FIGS., especially FIG. 4, a cutter/-crimper tool, generally designated as 10, is shown. The crimping or cutting action occurs between a pair of crimping arms 12*a* and 12*b*. Each arm is tapered as shown in FIG. 4, with arcuate cut out sections 14*a* and 14*b* at their ends. The arcuate cut out sections 14*a* and 14*b* are matching and allow a cable connector with stranded cable to be crimped to be fitted therein prior to crimping. Adjacent to the arcuate cut out sections 14*a* and 14*b* are cutting edges 16*a* and 16*b*. Cutting edges 16*a* and 16*b* are matched to provide cutting of stranded cable placed therein during operation of the device. It should be noted that locating the cutting edges 16*a* and 16*b* closer to the user than the crimping cut out portions 14*a* and 14*b* provides the possibility of greater torque relative to the crimping cut out section 14*a* and 14*b*.

Crimping arms 12*a* and 12*b* are contained partially within crimping arm mounting plates 18*a* and 18*b*. The arms 12*a* and 12*b* are sandwiched between these plates 18*a* and 18*b* and pinned thereto by pins 15*a* and 15*b*, and retainers 17*a*, 17*b*, and 17*c*. The crimping arm mounting plates 18*a* and 18*b* also partially contain a rod 20 which is bolted to plates 18*a* and 18*b* by bolts 19*a* and 19*b*. Rod 20 runs through an interior base plate 22 having a cylindrical flange 24. Rod 20 further continues through an expandable pressurized air bag 26, and an exterior base plate 28. The interior base plate 22 is attached to air bag 26 by pins 13*a* and 13*b*. The air bag 26 has a hole therethrough to accommodate rod 20. One end of rod 20 contains a threaded portion to receive a nut 30 and retain the rod 20 in the entire assembly. A bushing 32 is provided where rod 20 fits through the cylindrical flange 24 of interior base plate 22. Also, a rubber seal 34 is located adjacent to bushing 32. Adjacent to the cylindrical flange 24 is located a shockpad 36 to minimize shock to the user. Washers 21 and 23 are provided on either side of shock pad 36, and a washer 25 is provided on the exterior side of bushing 32. Handle bars 38 are mounted to the crimping arm mounting plate 18*a* by handle assembly mounting plate 40. Mounting plate 40 is connected to the assembly by bolts 19*a* and 19*b* and nuts 27*a* and 27*b*. Located on the handle bars 38 is a trigger or switch 42 which in turn is connected to a source of air pressure (not shown) of about 200 psi through fitting 33. Switch 42 is mounted to handle bars 38 by bolts 29*a* and 29*b* and nuts 31*a* and 31*b*. Switch 42 is connected to air bag 26 through line 35 and fitting 37 and 39, and upon depression of switch 42, the source of air pressure can inflate air bag 26.

Connected to crimping arms 12*a* and 12*b* are connecting arms 44*a* and 44*b* by pins 41*a* and 41*b*. The connecting arms 44*a* and 44*b* are pinned to crimping arms 12*a* and 12*b*, but rotation of the connecting arms 44*a* and 44*b* relative to the pins 41*a* and 41*b* is allowed. These connecting arms are in turn connected to the interior base plate 22 by pins 43*a* and 43*b* in such a way as to allow rotation in one dimension about those pins 43*a* and 43*b*. Springs 46*a* and 46*b* are stretched between bolts 48*a* and 48*b*, and bolts 50*a* and 50*b*, respectively. Bolts 48*a* and 48*b* run through crimping arm 12*a*, and bolts 50*a* and 50*b* run through crimping arm 12*b*. Nuts 52*a*, 52*b*, 52*c*, 52*d* retain bolts 48*a* 58*b*, 50*a*, and 50*b*, respectively. Springs 46*a* and 46*b* hold the cut out sections 14*a* and 14*b* of crimping arms 12*a* and 12*b* open prior to operation of the device. An aluminum housing 54 is provided to partially house assembly 10.

Figure 1:
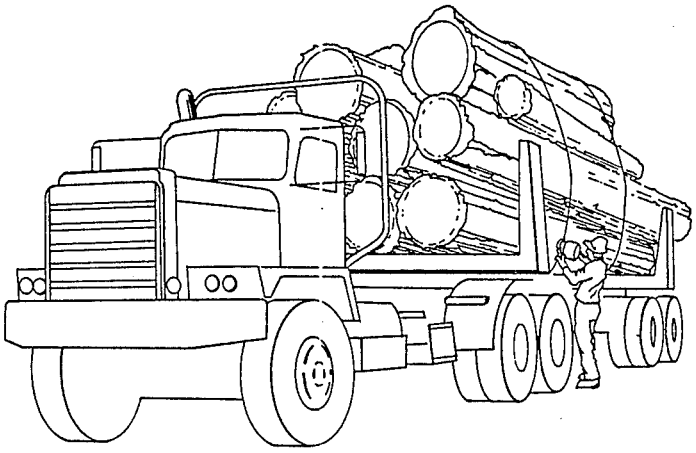
FIG. 1 is an isometric view showing field use of the present invention in cable strapping log bundles.
Figure 2:
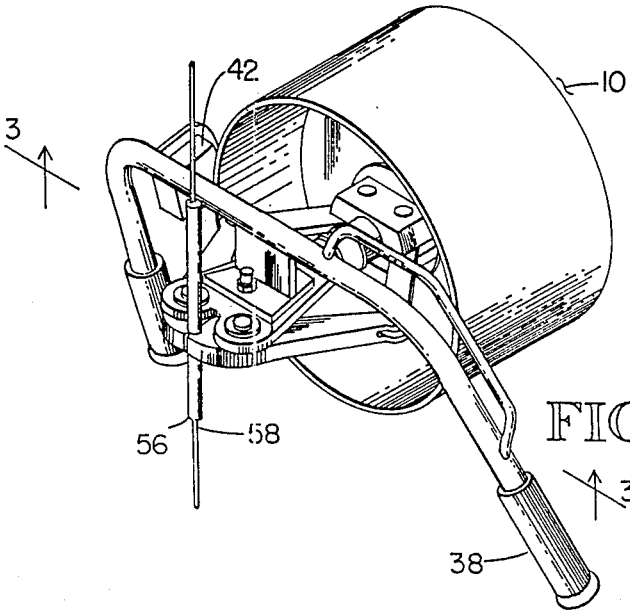
FIG. 2 is an isometric view of the present invention with a strand cable and cable connector between its crimping jaws.
Figure 3:
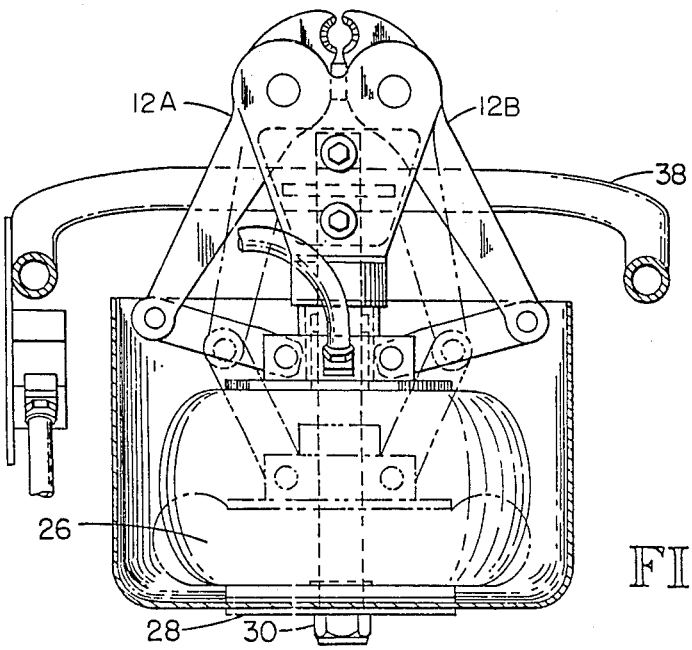
FIG. 3 is a view along line 3—3 of FIG. 2 with position of the crimping arms prior to operation shown in dotted lines. The solid lines showing the crimping arms as they are in a crimping or cutting position.

Referring to FIG. 2, in operation of the device the operator would grasp the tool assembly 10 by handle bars 38. Depression of trigger 42 would begin activation of the crimping action. Prior to pressing trigger 42, however, a cable connector 56 of a heat treated aluminum alloy would be used to contain the ends of the stranded cable 58 to be spliced. These cable connectors are well known in the cable crimping art and have been in use for some time. The cable connector containing the ends of the cable to be spliced would be placed between the cut out sections 14*a* and 14*b* of crimping arms 12*a* and 12*b*. Depression of trigger 42 would cause the inflation of air bag 26 by the outside source of air pressure (not shown). Inflation of air bag 26 would cause movement of interior base plate 22 toward the cable to be spliced along the axis of rod 20. This action would cause both a translational and rotational movement of connecting arms 44*a* and 44*b* which in turn would cause crimping arms 12*a* and 12*b* to rotate about their point of connection to the crimping arm mounting plates 18*a* and 18*b* as best shown in FIG. 3. The cut out sections 14*a* and 14*b* of crimping arms 12*a* and 12*b* would be forced closer together and effect crimping of the stranded cable 58 and connector 56.

If cutting of wire is desired instead of crimping, the wire to be cut can be placed between the cutting edges 16*a* and 16*b* of crimping arms 12*a* and 12*b*. Depression of trigger 42 will then force the cutting edges 16*a* and 16*b* together to effect cutting of the wire therebetween. Whether the assembly 10 is used for the cutting or crimping operation, upon release of trigger 42, the source of air pressure will be disconnected from air bag 26 and air bag 26 will deflate. Springs 46*a* and 46*b* will hold the cut out sections 16*a* and 16*b* of crimping arms 12*a* and 12*b* open to receive the stranded cable and connector for crimping of wire for cutting.

The invention may be embodied in other forms without departing from the spirit or essential characteristics thereof. The present embodiments are therefore to be considered in all respects as illustrative and not restrictive, the scope of the invention being indicated by the append claims rather than the foregoing description, and all change which comes within the meaning and range of equivalency of claims are intended to be embraced therein.

What we claim is:

1. Apparatus for crimping stranded cable comprising:

a. a frame;

b. a rod having one end connected to the frame, said rod having a baseplate mounted on the other end;

c. a pair of crimping arms having matching arcuate cut-out portions on the ends of said crimping arms for crimping a stranded cable placed therebetween, said crimping arms rotably connected to said frame;

d. connecting arms rotably pinned to said pair of crimping arms to allow rotation of said crimping arms relative to said connecting arms;

e. force transmission means having a hole therethrough to receive said rod; said force transmission means rotably pinned to said connecting arms whereby lateral movement of said force transmission means along the axis of said rod rotates said connecting arms and in turn said crimping arms about their point of connection to said frame and effects closing or opening of the arcuate cut-out portion of said crimping arms;

f. an inflatable air bag between the base plate of said rod and said force transmission means, said inflatable air bag having a hole therethrough to receive said rod and be supported by said rod, said air bag connected to a source of pressurized air, with expansion of said air bag causing lateral movement of said force transmission means along the axis of said rod;

g. trigger means mounted on said frame, said trigger means connected to said air bag and communicating with the source of pressurized air for allowing rapid expansion of said air bag and lateral movement of said force transmission means along the axis of said rod when said trigger is depressed thereby causing closing of the arcuate cut-out portions of said crimping arms and crimping of stranded cable placed therebetween, releasing said trigger means causing depressurization and contraction of said air bag.

2. The apparatus of claim 1 which further includes spring means connected to each end of said crimping arms opposite the arcuate cut-out portions for holding the arcuate cut-out portion apart when said trigger means is released, said spring means also causing one end of said air bag to remain adjacent to the base plate of said rod after said air bag has contracted.

3. The apparatus of claim 1 in which the ends of said crimping arms have matched cutting edges for cutting wire placed therebetween behind the arcuate cut-out portions, and along the center line of the apparatus.

4. The apparatus of claim 2 which includes a housing mounted on said frame to partially house the apparatus for crimping strand cable.

* * * * *